US005799814A

United States Patent [19]

Schaefer et al.

[11] Patent Number: 5,799,814

[45] Date of Patent: Sep. 1, 1998

[54] DRINK-THROUGH LID FOR CONTAINER

[75] Inventors: Robert J. Schaefer, Baltimore, Md.; William B. Pendergrass, Hanover, Pa.

[73] Assignee: Sweetheart Cup Company Inc., Owings Mills, Md.

[21] Appl. No.: 689,142

[22] Filed: Jul. 30, 1996

[51] Int. Cl.[6] ..... A47G 19/22; B65D 41/46; B65D 51/20

[52] U.S. Cl. ..... 220/254; 220/255; 220/266; 220/711; 220/714

[58] Field of Search ..... 220/711, 712, 220/713, 714, 715, 720, 255, 703, 265, 266, 281, 254

[56] References Cited

U.S. PATENT DOCUMENTS

| | | | |
|---|---|---|---|
| 3,915,331 | 10/1975 | Chenault | 220/714 X |
| 3,938,695 | 2/1976 | Ruff | 220/713 |
| 4,186,842 | 2/1980 | Albert | 220/203.04 |
| 4,285,442 | 8/1981 | Wedzik | 220/712 X |
| 4,586,625 | 5/1986 | Garrett | 220/712 X |
| 5,361,935 | 11/1994 | Sagucio | 220/720 X |

FOREIGN PATENT DOCUMENTS

| | | | |
|---|---|---|---|
| 2219930 | 12/1989 | United Kingdom | 220/715 |

*Primary Examiner*—Allan N. Shoap
*Assistant Examiner*—Niki M. Kopsidas
*Attorney, Agent, or Firm*—Nixon & Vanderhye PC

[57] ABSTRACT

A container lid includes a flap region that is selectively displaceable between a static raised position and a static depressed position. A flap is cut out of the flap region and is substantially integral with the flap region when the flap region is in the static raised position. When the flap region is displaced to the static depressed position, the flap separates from the flap region enabling liquid to flow therethrough. When the flap region is returned to the static raised position, the flap is again substantially integral with the flap region to thereby close the lid and prevent liquid from escaping. A knob is provided preferably integral with the flap region to facilitate displacement of the flap region.

12 Claims, 3 Drawing Sheets

2
2
10
12
18
20
26

DRINK-THROUGH LID FOR CONTAINER

BACKGROUND

The present invention relates to lids for liquid containers and, more particularly, to a drink-through lid for a paper container that is configured to enable automatic opening and closing of a drink-through flap.

Many drink through lids have been proposed for paper containers to enable a user to drink, for example, coffee without requiring the user to remove the lid. A drink-through lid helps to prevent spillage of the liquid as well as to prevent heat dissipation (in the case of a hot liquid such as coffee).

In U.S. Pat. No. 3,797,696, a container lid is disclosed that includes an arcuate center section 11 and a plurality of radially extending fingers 19, which are normally integral with the web portion 7 of the lid. When the extension 11 is pressed, the radially extending fingers 19 are urged downwardly and away from the web portion of the lid. The downward extension of the radially extending fingers 19 away from the web portion 7 exposes a series of liquid discharge slots 21 in the web portion 7. When the user relaxes the central extension 11, the radially extending fingers 19 return to their normal or sealing position to close the liquid discharge slots 21.

This structure, however, requires that the user maintain the central extension 11 in a depressed position in order to discharge liquid through the slots 21. With this structure, it is difficult and somewhat awkward to press the central extension 11 while drinking from the container.

SUMMARY OF THE INVENTION

It is therefore an object of the invention to provide a container lid for a paper container that obviates the disadvantages associated with the above-noted and other prior art container lids. In this regard, it is an object of the invention to provide a container lid that is selectively movable between a raised position and a depressed position without requiring the user to maintain contact with the lid while drinking from the container (i.e., a static raised position and a static depressed position).

These and other objects of the invention are achieved by providing a container lid including a web portion having a flap region selectively displaceable between a static raised position and a static depressed position, a flap cut out of the flap region that is substantially integral with the flap region when the flap region is in the static raised position and separated from the flap region when the flap region is in the static depressed position. A knob may be provided secured to the flap region, which is graspable to facilitate displacement between the static depressed position and the static raised position.

The knob preferably includes at least two side walls extending substantially perpendicular from the flap region that are deformable. In this regard, the knob is preferably diamond shaped. Moreover, the knob may be integral with the flap region. A vent hole may be provided in the knob so that the vent hole is disposed spaced from the web portion.

A center of the flap region is preferably raised above the web portion in the raised position and the center is depressed below the web portion in the depressed position. The web portion may be substantially flat and the flat region shaped substantially as a spherical cap segment, wherein a center of the flap region is raised above the web portion in the raised position, and the center is depressed below the web portion in the depressed position.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Referring to the FIGURES, the lid 10 according to the present invention includes a substantially circular web portion 12 and a cylindrical skirt 14 formed integrally of plastic or the like. The skirt 14 depends from the periphery of the web portion 12 and is adapted to frictionally engage the outer surface of a container side wall to cover a container opening. The web portion 12 may be provided with annular ridges or depressions (not shown) to permit a plurality of container lids to be stacked and nested together for efficient and secure storage.

Figure 2:
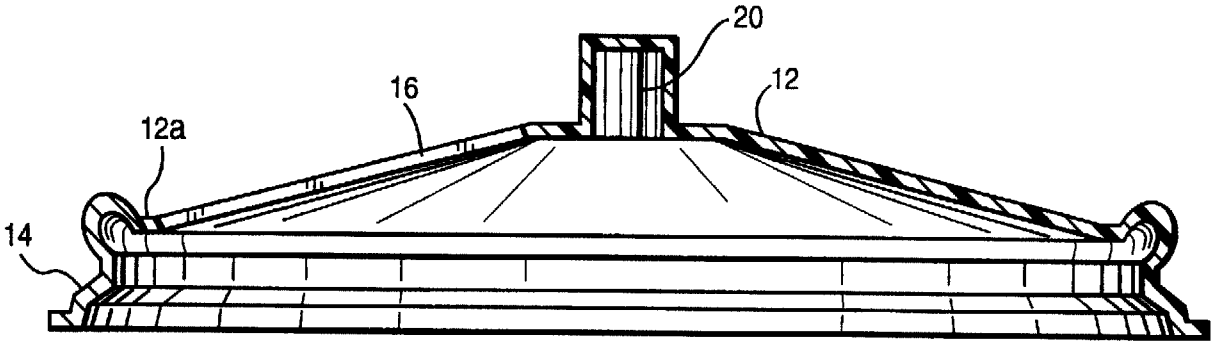
FIG. 2 is a cross-sectional view of the lid taken along line 2—2 in FIG. 1 with the lid in its raised position.
Figure 3:
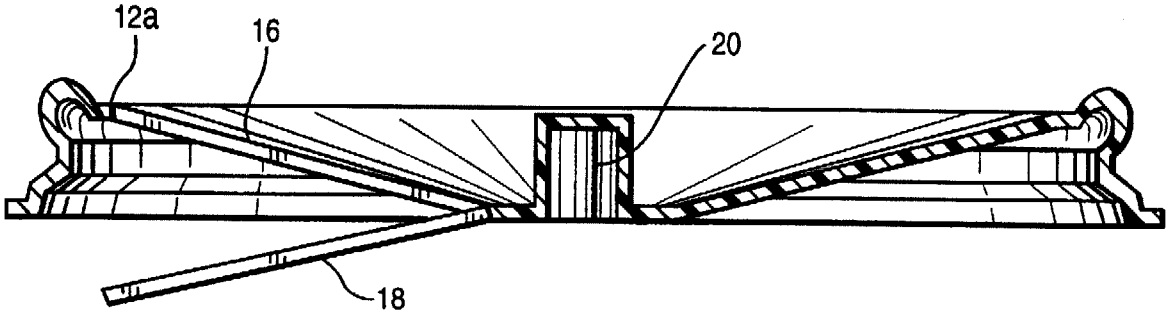
FIG. 3 illustrates the lid of FIG. 2 in its depressed position.
Figure 4:
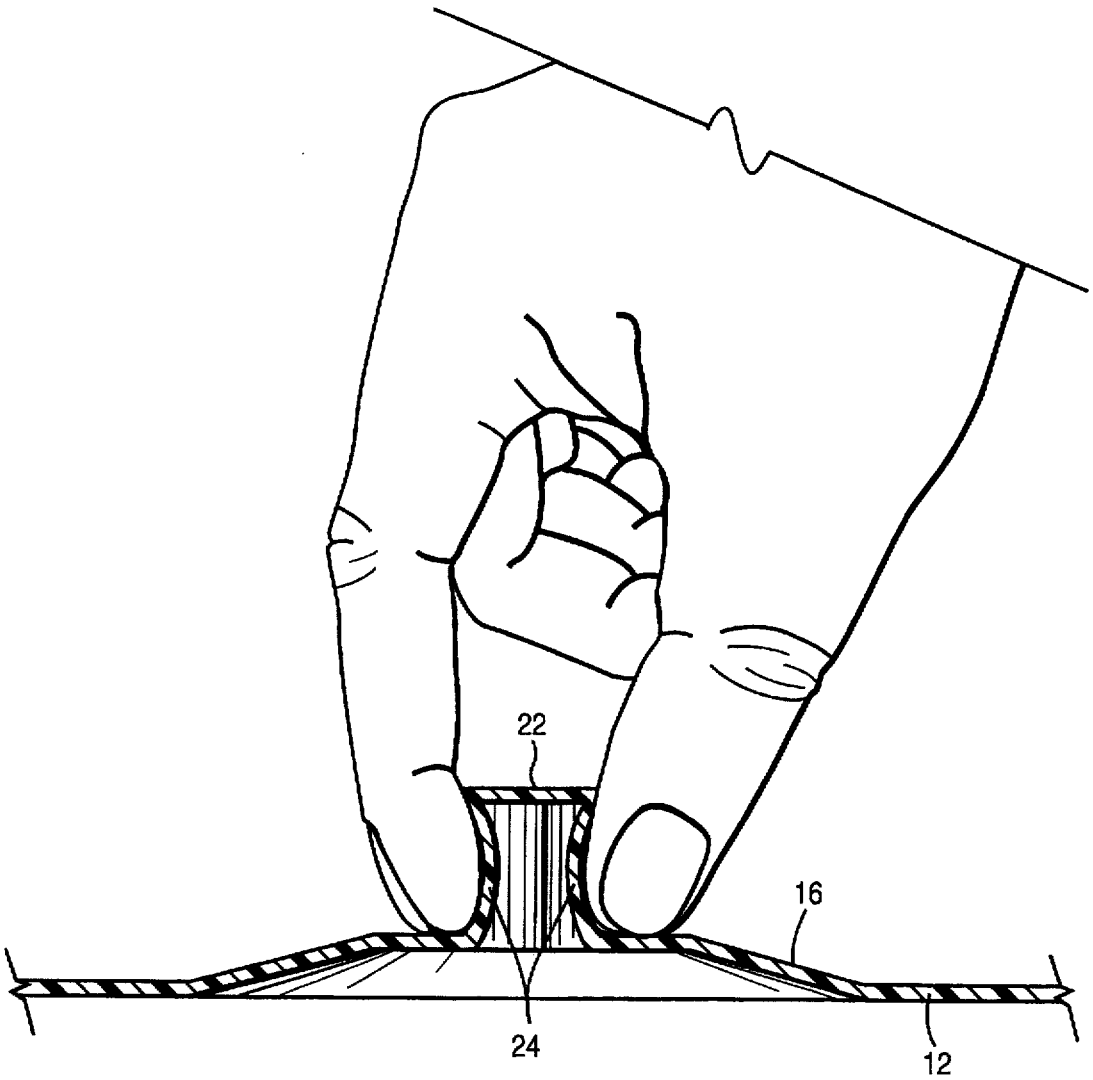
FIG. 4 illustrates a feature according to the present invention facilitating displacement of the lid between its depressed position and its raised position.

Referring to FIGS. 2 and 3, the web portion 12 includes a flap region 16 that is selectively displaceable between a static raised position (FIG. 2) and a static depressed position (FIG. 3). The flap region 16 in FIGS. 2 and 3 substantially includes the entire web portion 12. As shown in FIG. 4, the flap region 16 may comprise an area smaller than the entire web portion 12 such that a center of the flap region 16 is raised above the web portion 12 in the static raised position, and the center of the flap region 16 is depressed below the web portion 12 in the static depressed position. In this regard, the web portion is substantially flat, and the flap region 12 may be shaped substantially as a spherical cap segment or the like. For example, the flap region 16 may have a diameter at the web portion of between 0.5–2 inches. In a preferred arrangement, the flap region has a diameter at the web portion of about 1 inch.

Figure 1:
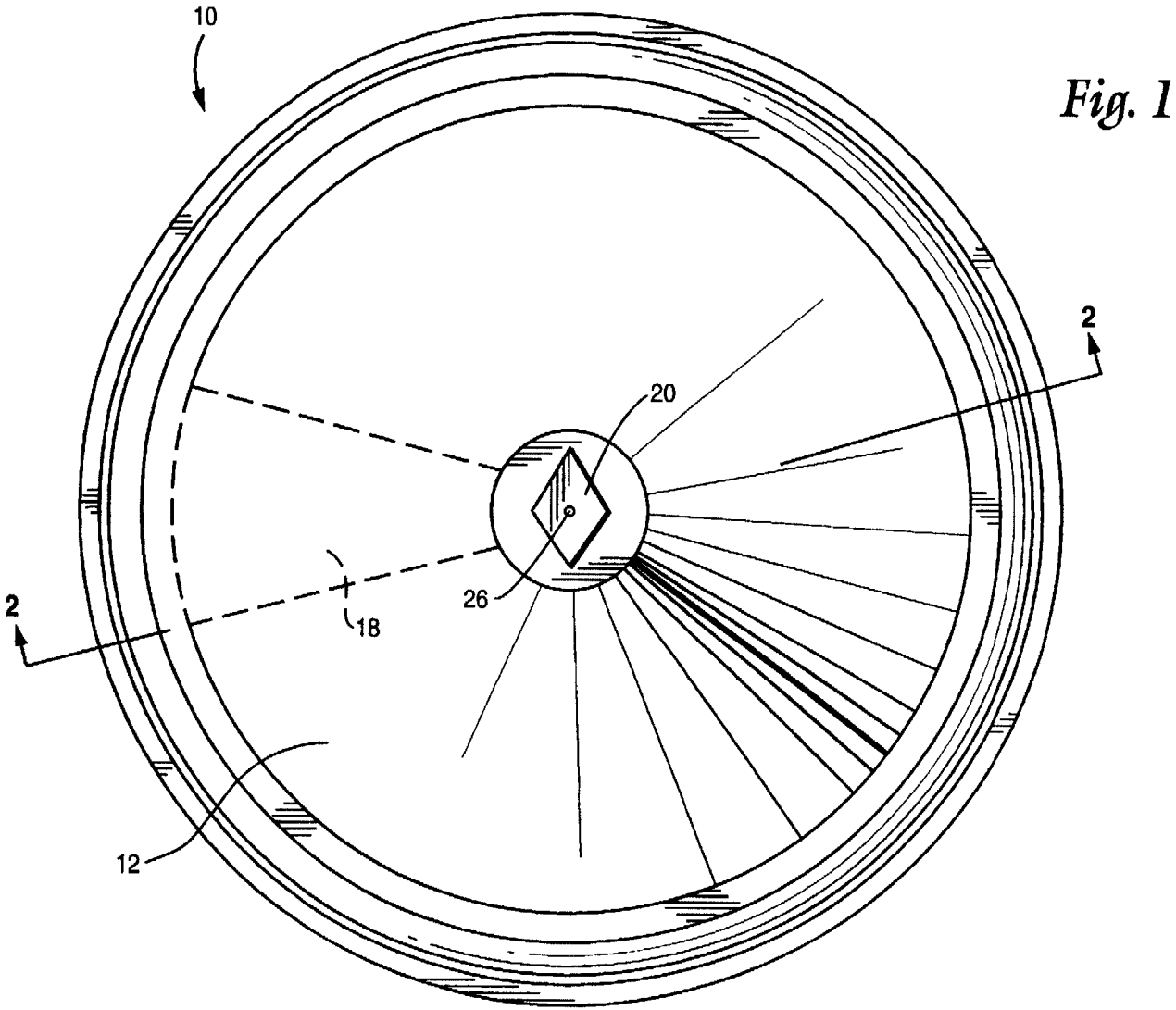
FIG. 1 is a plan view of an exemplary container lid according to the present invention.

The flap region 16 includes a flap 18 that is cut out of the flap region 16. The flap 18 in FIG. 1 is shown in an arcuate shape, however, many other shapes would be suitable. Preferably, the flap 18 is cut out of the flap region 16 along three sides such that a radially innermost end of the flap 18 remains permanently attached to the flap region 16.

In the static raised position as shown in FIG. 2, the flap region 16 extends upwardly from a horizontal plane defined by the periphery 12*a* of the web portion 12. By virtue of the flap region shape, the flap region 16 is maintained in the static raised position without any external forces acting thereon. As shown in FIG. 2, in the static raised position, the flap 18 is substantially integral with the flap region 16, thereby closing the lid and preventing the contents of the container from escaping.

Referring to FIG. 3, the flap region 16 may be selectively displaced to a static depressed position, wherein no external forces acting on the flap region 16 are required to maintain the flap region in the static depressed position. Because the flap 18 is cut out from the flap region 16 and therefore detached from the web portion periphery 12*a*, the flap 18 maintains its shape from the static raised position. Thus, as shown in FIG. 3, the flap separates from the flap region 16 when the flap region is in the static depressed position, thereby allowing a user to drink through the opening formed in the lid. When the flap region 16 is returned to the static raised position, the flap 18 is again substantially integral with the flap region to thereby close the lid 10 and prevent liquid from escaping.

A knob 20 is secured to the flap region 16 to facilitate displacement between the static depressed position and the static raised position. In a preferred arrangement, the knob is formed integrally with the lid 10. Referring to FIG. 4, the knob includes a top rigid surface 22 and at least a pair of deformable side walls 24. With this structure, the knob 20 can be easily grasped between the fingers of a user, particularly facilitating displacement between the static depressed position and the static raised position. In one arrangement, the knob 20 is diamond shaped.

The knob 20 may also be provided with a vent hole 26 to improve the flow characteristics of liquid caused to flow through the open flap 18. The thusly raised vent hole is spaced from the web portion 12 and the liquid in the container, thereby preventing liquid from splashing outside of the container through the vent hole.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims. In particular, the features of the present invention are applicable to numerous lid configurations and shapes, and the invention is not meant to be limited to the particular arrangement that is illustrated and described.

What is claimed is:

1. A container lid comprising:

a web portion shaped to fit a container;

a flap region formed integral with said web portion and being selectively displaceable between a static raised position wherein said flap region is maintained without an external application of force and a static depressed position wherein said flap region is maintained without an external application of force; and a flap cut out of said flap region, said flap being substantially integral with said flap region when said flap region is in said static raised position, and said flap being separated from said flap region when said flap region is in said static depressed position.

2. A container lid according to claim 1, wherein a center of said flap region is raised above said web portion in said raised position and said center is depressed below said web portion in said depressed position.

3. A container lid according to claim 1, wherein said web portion is substantially flat and said flap region is shaped substantially as a spherical cap segment, wherein a center of said flap region is raised above said web portion in said raised position and said center is depressed below said web portion in said depressed position.

4. A container lid comprising:

a web portion shaped to fit a container;

a flap region formed integral with said web portion and being selectively displaceable between a static raised position wherein said flap region is maintained without an external application of force and a static depressed position wherein said flap region is maintained without an external application of force;

a flap cut out of said flap region, said flap being substantially integral with said flap region when said flap region is in said static raised position, and said flap being separated from said flap region when said flap region is in said static depressed position; and a knob secured to said flap region, said knob being graspable to facilitate displacement between said static depressed position and said static raised position.

5. A container lid according to claim 1, wherein said knob comprises at least two side walls extending substantially perpendicular from said flap region, said side walls being deformable.

6. A container lid according to claim 5, wherein said knob is diamond shaped.

7. A container lid according to claim 4, wherein said knob is integral with said flap region.

8. A container lid according to claim 4, wherein a center of said flap region is raised above said web portion in said raised position and said center is depressed below said web portion in said depressed position.

9. A container lid according to claim 4, wherein said web portion is substantially flat and said flap region is shaped substantially as a spherical cap segment, wherein a center of said flap region is raised above said web portion in said raised position and said center is depressed below said web portion in said depressed position.

10. A container lid according to claim 9, wherein said flap region has a diameter at said web portion of between 0.5–2".

11. A container lid according to claim 10, wherein said flap region has a diameter at said web portion of about 1".

12. A container lid according to claim 4, wherein said knob comprises a vent hole.

* * * * *